US008611806B2

(12) United States Patent
Imai

(10) Patent No.: US 8,611,806 B2
(45) Date of Patent: Dec. 17, 2013

(54) ELECTROPHOTOGRAPHIC IMAGE FORMING APPARATUS USING INTERMEDIATE IMAGE TRANSFER ENDLESS BELT

(75) Inventor: Masashi Imai, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 142 days.

(21) Appl. No.: 13/359,559

(22) Filed: Jan. 27, 2012

(65) Prior Publication Data

US 2012/0195629 A1 Aug. 2, 2012

(30) Foreign Application Priority Data

Jan. 31, 2011 (JP) ..... 2011-018774

(51) Int. Cl.
*G03G 21/16* (2006.01)

(52) U.S. Cl.
USPC ..... 399/392; 399/111

(58) Field of Classification Search
USPC ..... 399/111–114, 124, 392
See application file for complete search history.

(56) References Cited

U.S. PATENT DOCUMENTS

| | | | | |
|---|---|---|---|---|
| 5,867,181 | A | 2/1999 | Nakane et al. | |
| 6,041,203 | A | 3/2000 | Suzuki et al. | |
| 6,330,410 | B1 | 12/2001 | Okabe et al. | |
| 7,209,681 | B2 | 4/2007 | Yamada et al. | |
| 7,227,562 | B2 | 6/2007 | Asuwa et al. | |
| 7,257,349 | B2 * | 8/2007 | Kitozaki | 399/111 |
| 7,764,903 | B2 | 7/2010 | Ishikawa et al. | |
| 8,233,819 | B2 | 7/2012 | Kondo | |
| 2004/0085431 | A1 | 5/2004 | Asuwa et al. | |
| 2004/0091290 | A1 | 5/2004 | Yamada et al. | |
| 2009/0060568 | A1 | 3/2009 | Ishikawa et al. | |
| 2009/0142092 | A1 | 6/2009 | Sato | |
| 2010/0074648 | A1 | 3/2010 | Kondo | |

FOREIGN PATENT DOCUMENTS

| | | | |
|---|---|---|---|
| JP | 06-130744 | A | 5/1994 |
| JP | 08-282009 | | 10/1996 |
| JP | 2001-075457 | A | 3/2001 |
| JP | 2004-189437 | | 7/2004 |
| JP | 2004-206071 | A | 7/2004 |
| JP | 2006-301385 | | 11/2006 |
| JP | 2009-058740 | | 3/2009 |
| JP | 2009-157135 | | 7/2009 |
| JP | 2010-072588 | A | 4/2010 |

OTHER PUBLICATIONS

JP Office Action dtd Mar. 12, 2013, JP Appln. 2011-018774, English translation [Corrected].

* cited by examiner

*Primary Examiner* — David Gray
*Assistant Examiner* — Carla Therrien
(74) *Attorney, Agent, or Firm* — Banner & Witcoff, Ltd.

(57) ABSTRACT

An image forming apparatus includes an endless belt operating as an intermediate image transfer member. A plurality of process cartridges is juxtaposed along the endless belt. Each process cartridge includes a photosensitive drum confronting the endless belt and a developing agent carrying member disposed in confronting relation with the photosensitive drum for supplying toner to the photosensitive drum. A first conveying member is provided in each process cartridge. A second conveying member is provided in the housing, and the first conveying member conveys a recording sheet in cooperation with the second conveying member.

8 Claims, 4 Drawing Sheets

ELECTROPHOTOGRAPHIC IMAGE FORMING APPARATUS USING INTERMEDIATE IMAGE TRANSFER ENDLESS BELT

CROSS REFERENCE TO RELATED APPLICATION

This application claims priority from Japanese Patent Application No. 2011-018774 filed Jan. 31, 2011. The entire content of the priority application is incorporated herein by reference.

TECHNICAL FIELD

The present invention relates to an electrophotographic image forming apparatus. More particularly, the invention relates to a color image forming apparatus of the type using an intermediate image transfer endless belt.

BACKGROUND

Electrophotographic color printers have been known and used in various fields. Typically, such a printer accommodates four photosensitive drums corresponding to four colors of yellow, magenta, cyan and black.

One electrophotographic color printer includes four photosensitive drums juxtaposed horizontally, an intermediate image transfer belt, and a secondary image transfer roller. The intermediate image transfer belt is in the form of an endless belt and has an image receiving surface circularly horizontally moving between a pair of spaced-apart support rollers. The photosensitive drums are disposed above the image receiving surface of the intermediate image transfer belt.

The printer is provided with a sheet cassette disposed below the photosensitive drums. A stack of recording sheets is stored in the sheet cassette. The uppermost sheet is fed out from the sheet cassette and conveyed upward while passing by one horizontal end of the intermediate image transfer belt. The recording sheet passes through a gap between the horizontal end of the intermediate image transfer belt and the secondary image transfer roller. The recording sheet is further conveyed upward and then conveyed toward the upper portion of another horizontal end of the intermediate image transfer belt. Thus, the recording sheet is discharged onto a discharge tray formed on the upper surface of the printer. That is, the color printer as described above includes a C-shaped sheet conveying path.

SUMMARY

It is conceivable to form another sheet conveying path between the horizontally juxtaposed photosensitive drums and the sheet cassette for conveying a manually inserted recording sheet. However, the structure of the printer would be complicated and enlarged if the second sheet conveying path is formed in the above-described location. Further, it would be difficult to recover accidentally occurring paper jam.

In view of the foregoing, in accordance with one aspect of the invention, there is provided an image forming apparatus that includes a housing, a driving source, an endless belt, a plurality of process cartridges, a first conveying member, and a second conveying member. The driving source generates driving force. The endless belt is circularly movably disposed in the housing. The endless belt has a first part moving in a first direction and a second part moving in a second direction opposite the first direction. The plurality of process cartridges is detachably provided in the housing and juxtaposed along the first part of the endless belt. Each of the plurality of process cartridges includes a photosensitive drum extending in a third direction perpendicular to the first direction and the second direction to confront the first part of the endless belt. A developing agent carrying member is disposed in confronting relation with the photosensitive drum for supplying developing agent to the photosensitive drum. The first conveying member is provided in each of the plurality of process cartridges. The second conveying member is provided in the housing. The first conveying member conveys a recording sheet in the first direction in cooperation with the second conveying member.

BRIEF DESCRIPTION OF THE DRAWINGS

The particular features and advantages of the invention will become apparent from the following description taken in connection with the accompanying drawings, in which.

DETAILED DESCRIPTION

Figure 1:
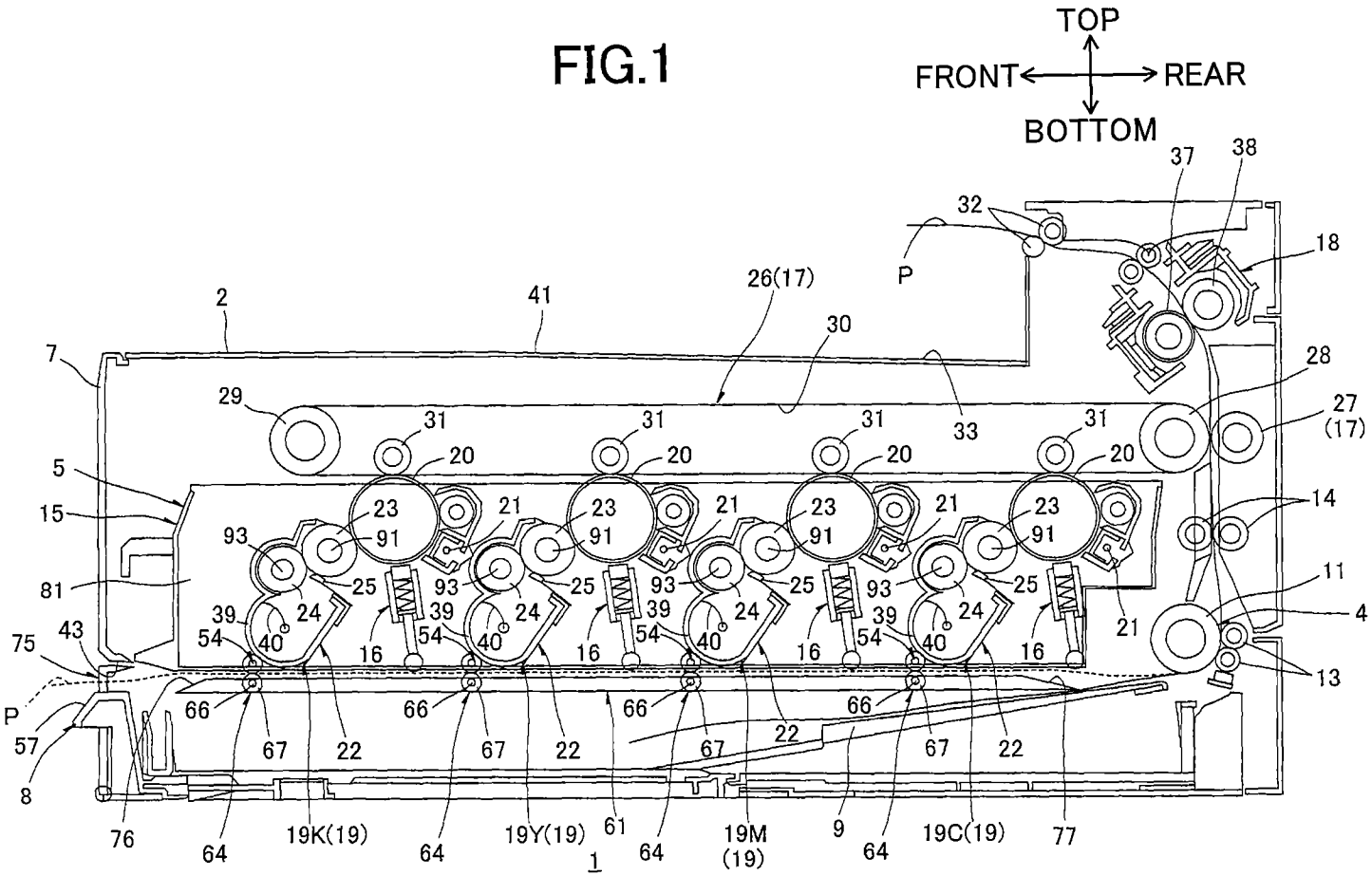
FIG. 1 is a vertical cross-sectional view showing a color printer in accordance with en embodiment of the invention.

A color printer 1 shown in FIG. 1 is one example of an image forming apparatus of the invention. The color printer 1 is of a horizontal type and also of an intermediate image transfer type in which a toner image is once transferred onto the intermediate image transfer belt and the image thereon is finally transferred onto a sheet of paper P. A sheet of paper P is one example of a recording medium on which the image is formed. Throughout the specification, the terms "upper", "lower", "right", "left", "front", "rear" and the like will be used assuming that the color printer 1 is disposed in an orientation in which it is intended to be used.

As shown in FIG. 1, the color printer 1 includes a housing 2 within which a sheet supplying section 4 and an image forming unit 5 are provided. The sheet supplying section 4 is provided for feeding a sheet of paper P toward the image forming unit 5 where images are formed on the sheet of paper P.

The housing 2 is substantially of a box-shaped and an L-shaped as viewed from right or left. A front cover 7 is pivotally movably supported to a lower position of the front wall of the housing 2 so as to cover and expose an opening formed on a front wall of the housing 2. Another opening 43 is formed in the front wall of the housing 2 at a position below the front cover 7 for inserting a sheet tray 8 into and removing the sheet supply tray 8 from the housing 2. It should be noted that the front side of the housing 2 is left side in FIG. 1 whereas the rear side of the housing 2 is right side in FIG. 1. The right side of the housing 2 as viewed from the front side of the housing 2 is near side in FIG. 1 whereas the left side of the housing 2 as viewed from the front side of the housing 2 is far side in FIG. 1.

The sheet supply section 4 includes the sheet tray 8 for accommodating a stack of sheets of paper P therein. The sheet tray 8 is detachably disposed at a lower portion of the housing 2. The sheet tray 8 is provided with a lift member 9 for lifting and descending the rear end portion of the sheet of paper P. The lift member 9 is substantially of a plate-shape extending in front-to-rear direction and disposed in the bottom of the sheet tray 8. The lift member 9 is pivotally movable about its front end portion. The rear end portion of the lift member 9 is upwardly urged by an urging member, such as spring (not shown). By virtue of the urging force of the urging member, the lift member 9 is held slanted to increase its height toward the rear end thereof Thus, the rear end portion of a sheet of paper P is held upward toward a sheet feed roller 11 (to be described later).

The sheet supplying section 4 includes the sheet feed roller 11, a pair of pinch rollers 13, and a pair of registration rollers 14. The sheet feed roller 11 is rotatably disposed above the rear end portion of the sheet tray 8. The pair of pinch rollers 13 is substantially vertically disposed at the rear side of the sheet feed roller 11 to be rotatable with the sheet feed roller 11. The registration rollers 14 are arranged in the front-to-rear direction and in pressure contact with each other. The registration rollers 14 are disposed above the sheet feed roller 11 or downstream of the sheet feed roller 11 with respect to the sheet feed direction.

The uppermost sheet of paper P on the sheet tray 8 is fed toward a nip between the sheet feed roller 11 and each of the pinch rollers 13 in accordance with the rotations of the sheet feed roller 11. The sheet of paper P is further fed toward a nip between the registration rollers 14. The registration rollers 14 feed the sheet of paper P at a prescribed timing into a nip between the image forming section 5 (intermediate image transfer belt 30 to be described later) and a secondary image transfer roller 27 (to be described later). The path along which the sheet of paper P is conveyed as described above will be referred to as "first conveying path" hereinafter.

The image forming unit 5 is disposed above the sheet supply section 4 and includes a process unit 15, an image transfer unit 17 and a fixing unit 18. The process unit 15 includes four process cartridges 19 corresponding to four colors. The process unit 15 is slidably movable in the front-to-rear direction between a mount position in the housing 2 in which the process unit 15 is mounted and a pull-out position where the process unit 15 is pulled out from the housing 2 for replacement of the used process cartridge 19 with a new one. The process unit 15 at the mount position can be drawn out to the pull-out position.

The four process cartridges 19 are juxtaposed in spaced apart in the front-to-rear direction. Specifically, black process cartridge 19K, yellow process cartridge 19Y, magenta process cartridge 19M, and cyan process cartridge 19C are disposed from the front side toward the rear side in the stated order. Each process cartridge 19 includes photosensitive drum 20, Scorotron charger 21, developing unit 22, and LED unit 16. Each photosensitive drum 20 is substantially in the form of cylinder extending in the left-to-right direction.

The Scorotron charger 21 is spaced apart from and in confrontation with the photosensitive drum 20 at the rear lower side of the photosensitive drum 20. The four developing units 22 are juxtaposed in the front-to-rear direction with a predetermined interval between two adjacent developing units 22. Each developing unit 22 is disposed in the front lower side of the corresponding photosensitive drum 20. Each developing unit 22 has a developing roller 23 functioning as a developing agent carrying member.

The developing roller 23 is rotatably supported at the upper side of the corresponding developing unit 22. The rear upper portion of the developing roller 23 is exposed for contacting the corresponding photosensitive drum 20 at the front lower portion thereof. The developing unit 22 includes a supply roller 24 for supplying developing agent, toner in this embodiment, to the developing roller 23, and a thickness regulating blade 25 for regulating the thickness of toner deposited on the developing roller 23. Four toner accommodating sections 39 are disposed below the respective supply rollers 24. The toner accommodating section 39 is a hollow cylinder in which toner is accommodated. Four different colors of toner are separately accommodated in the four toner accommodating sections 39.

An agitator 40 is rotatably provided inside the toner accommodating section 39. Rotations of the agitator 40 agitate toner accommodated in the toner accommodating section 39 and supply toner to the corresponding supply roller 24.

Four LED units 16 are provided corresponding to the four developing units 22. Each LED unit 16 is disposed at a rear position of the corresponding developing unit 22. The LED unit 16 is oriented substantially upward to irradiate the lower portion of the photosensitive drum 20 with light. The surface of the photosensitive drum 20 is exposed to light emitted from the LED unit 16 based on image data.

The image transfer unit 17 includes a belt unit 26 and a secondary image transfer roller 27. The belt unit 26 is disposed above the process unit 15 and contacts the respective photosensitive drums 20. The belt unit 26 includes an endless belt 30 circularly movable between two spaced-apart rollers 28, 29. The endless belt 30 has a lower part moving in rear ward and an upper part moving frontward. The endless belt 30 functions as an intermediate image transfer belt. A drive roller 28 and a follow roller 29 support the intermediate image transfer belt 30 with taut. The image transfer unit 17 further includes four primary transfer rollers 31.

The primary transfer roller 31 is disposed above the corresponding photosensitive drum 20 and in confrontation therewith with the lower part of the intermediate image transfer belt 26 interposed therebetween. The secondary image transfer roller 27 is rotatably disposed at the rear side of the belt unit 26 to confront the drive roller 28 of the belt unit 26 with the intermediate image transfer belt 30 interposed therebetween. The fixing unit 18 is disposed above the secondary image transfer roller 27 and includes a heat roller 37 and a pressure roller 38.

In operation, toner accommodated in the toner accommodating section 39 is supplied to the supply roller 24 and the latter conveys toner to the developing roller 23. By virtue of the thickness regulating blade 25, toner deposited on the developing roller 23 is regulated to be uniform in thickness as the developing roller 23 rotates. As a result, a thin toner layer with a predetermined thickness is carried on the surface of the developing roller 23. Toner carried on the developing roller 23 is frictionally charged to positive polarity at a position between the thickness regulating blade 25 and the developing roller 23.

The surface of the photosensitive drum 20 is uniformly charged to positive polarity by means of the Scorotron charger 21 as the photosensitive drum 20 rotates, and thereafter exposed to light emitted from the LED unit 16, thereby forming an electrostatic latent image on the surface of the photosensitive drum 20 based on the image data indicating an image to be formed on the sheet of paper P.

Further rotations of the photosensitive drum 20 bring the electrostatic latent image to the position where the developing roller 23 is disposed.

The electrostatic latent image is developed by the toner carried on the developing roller 23 to be a visible image. The photosensitive drum 20 carries a reversely developed toner image thereon. The toner images carried on the respective photosensitive drums 20 are sequentially transferred onto the lower part of the intermediate image transfer belt 30 moving rearward to overlap one on the other, thereby forming a full color image on the intermediate image transfer belt 30.

The color image on the intermediate image transfer belt 30 is then transferred onto a sheet of paper P when the color image on the intermediate image transfer belt 30 passes a position N where the intermediate image transfer belt 30 confronts the secondary image transfer roller 27. The sheet of paper P on which the color image is transferred is fed to the fixing unit 18. In the fixing unit 18, the color image on the sheet of paper P is thermally fixed when the sheet of paper P passes through a nip between the heat roller 37 and the pressure roller 38. The sheet of paper P with the color image fixed thereon is then discharged by a discharge roller 32 onto a discharge tray 33 formed on the upper surface of the housing 2.

The sheet tray 8 has a rectangular bottom and a front wall smaller in height than the vertical length of the opening 43 formed in the housing 2. The upper end face of the front wall is in confrontation with the upper edge of the opening 43 with a spacing therebetween. A grip portion 57 is formed in the upper portion of the front wall and protrudes frontward. The rear part of the grip portion 57 extends horizontally frontward and the front part of the grip portion 57 is obliquely bent downward to form an inner space into which the user's fingers are insertable to enable the sheet tray 8 to be drawn out of the housing 2 and inserted into the housing 2.

An opening 75 is formed between the upper surface of the grip portion 57 and the upper edge of the opening 43. The opening 75 is used as a port for manually inserting a sheet of paper P into the housing 2 for printing.

A sheet conveying member 61 is provided between the sheet tray 8 and the process unit 15. The sheet conveying member 61 is substantially of a plate shape extending in the front-to-rear direction. The front end portion of the sheet conveying member 61 is in confrontation with the front upper portion of the sheet tray 8. The front end portion of the sheet conveying member 61 is formed with a slanted surface with its height becoming higher toward the rear side. The sheet conveying member 61 has a rear end portion configured to be a wedge shape as viewed from right. The rear end portion of the sheet conveying member 61 is in confrontation with the rear portion of the lift member 9. The rear end portion of the sheet conveying member 61 is formed with a rear-side guide surface 77 which is slanted downward toward the rear side. The sheet conveying member 61 includes four housing-side feed rollers 64 for conveying a sheet of paper P.

The four housing-side feed rollers 64 are provided corresponding to four developing-side feed rollers 54 (to be described later), respectively. Each pair of the housing-side feed roller 64 and the developing-side feed roller 54 is vertically aligned to be rotatable and in confrontation with each other. Each housing-side feed roller 64 is made up of a roller shaft 66 and a roller portion 67. The roller portion 67 engages the roller shaft 66 so as not to be capable rotating independently of each other but to be rotatable together. The roller shaft 66 is substantially in the form of cylinder extending in the left-to-right direction. Each roller portion 67 has an outer diameter larger than the thickness of the sheet conveying member 61 and an inner diameter approximately equal to the outer diameter of the roller shaft 66. The roller portion 67 is substantially of cylindrical shape extending in the left-to-right direction.

The housing 2 has a top cover 41 that covers the upper wall and the upper portion of the rear wall of the housing 2. The top cover 41 is pivotally movably about a fulcrum located on the rear wall of the housing 2 at a position behind the fixing unit 18. With a support mechanism (not shown), the belt unit 26 and the fixing unit 18 are supported by the top cover 41. The top cover 41 pivotally moves together with the belt unit 26 and the fixing unit 18. When the top cover 41 is open, the process unit 15 is exposed, allowing the user to access the process cartridges 19 through the fully exposed opening in the upper portion of the housing 2.

The process unit 15 has a process frame 81 for holding the process cartridges 19 and the LED units 16. The process frame 81 is substantially of a rectangular shape having a front, rear, left and right side walls. The upper and lower sides of the process frame 81 are open. Supports (not shown) for supporting both ends of each of the process cartridges 19 are formed in the left and right side walls of the process frame 81.

In each process cartridge 19, the photosensitive drum 20, the Scorotron charger 21, and the developing unit 22 are supported between a pair of side plates (not shown) disposed in spaced apart and confronting relation with each other. Both axial ends of the photosensitive drum 20 are rotatably supported on the supports formed on the pair of side plates. Also, the left and right side ends of the Scorotron charger 21 are supported on another supports formed on the pair of side plates.

Figure 2B:
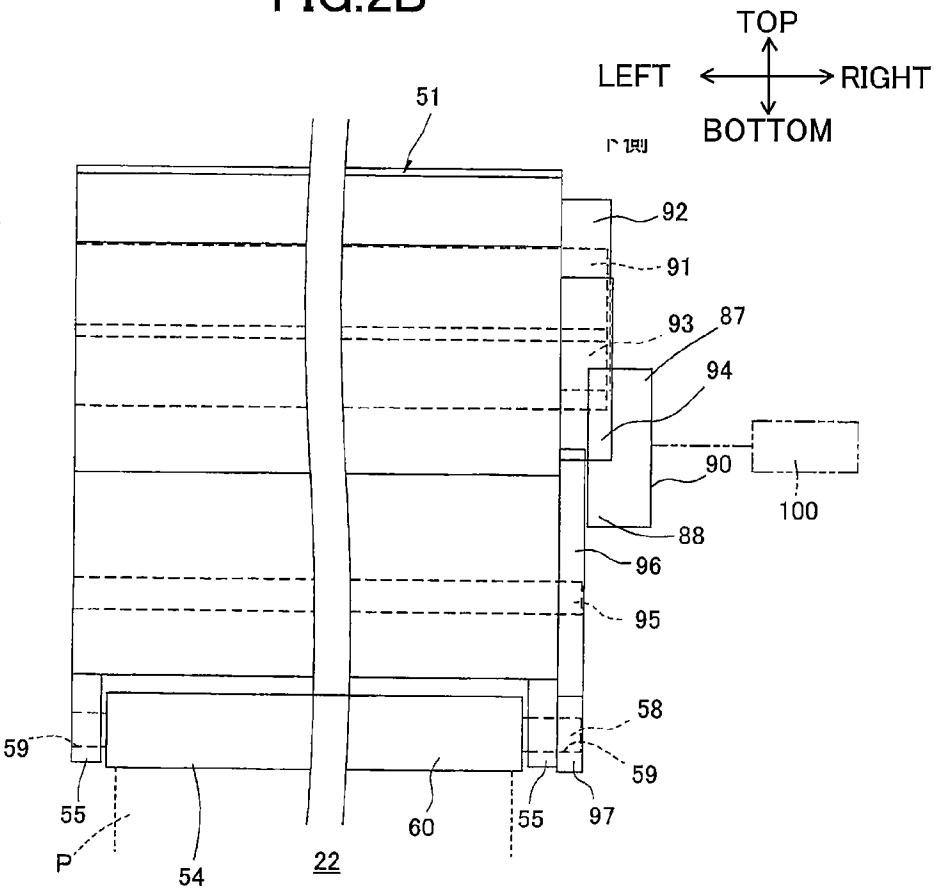
FIG. 2B is a plan view showing the developing unit incorporated in the color printer shown in FIG. 1.
Figure 2A:
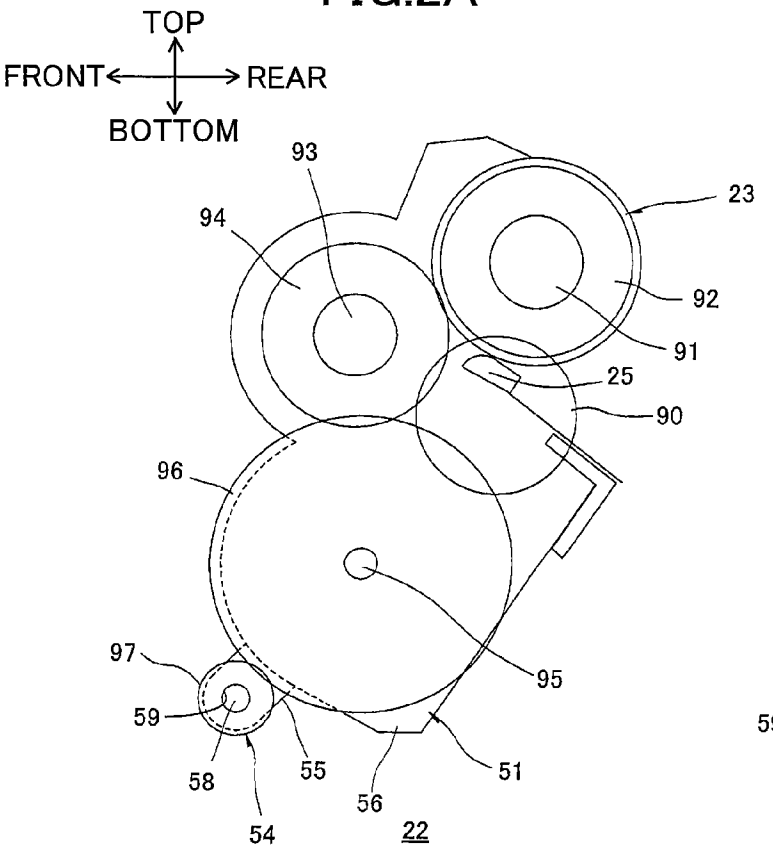
FIG. 2A is a right side view showing a developing unit incorporated in the color printer shown in FIG. 1.

As shown in FIGS. 1, 2A and 2B, the developing unit 22 is provided with a developing frame 51 and the developing-side feed roller (first conveying member) 54. The developing frame 51 is substantially of a box-shape extending in the left-to-right direction. As shown in FIG. 2A, each side wall of the developing frame 51 includes circular portions corresponding to the side portion of the toner accommodating section 39 and to the support portion of the supply roller 24. The developing frame 51 includes left- and right-side supporting portions 55 for supporting the developing-side feed roller 54, and a guide portion (guide member) 56.

Each of the left- and right-side supporting portions 55 is substantially of a plate-shape and is formed with a rounded top portion obliquely extending front-downward. The left- and right-side supporting portions 55 are spaced apart by a distance greater than the widthwise dimension of the sheet of paper P as can be seen from FIG. 2B. Each of the left- and right-side supporting portions 55 is formed with an insertion hole 59 for insertion of the developing-side roller shaft 58 (to be described later) of the developing-side feed roller 54. The insertion hole 59 is a through-hole having a circular cross-section and extending in the left-to-right direction. The inner diameter of the insertion hole 59 is approximately the same or slightly larger than the diameter of the developing-side roller shaft 58.

The guide portion 56 protrudes downward from the lower edge of the developing frame 51. The guide portion 56 has a lowermost flat end face extending in the front-to-rear direction. The guide portion 56 is configured to have the lowermost flat end face same in the vertical position as the lowermost edge of the supporting portion 55.

The developing-side feed roller 54 is rotatably supported between the two supporting portions 55. The developing-side feed roller 54 and the guide portion 56 of the developing frame 51 are in such a positional relation that the two are overlapped when the two are projected in the front-to-rear direction. The developing-side feed roller 54 includes a developing-side roller shaft 58 and a developing-side roller portion 60 which rotates together with the developing-side roller shaft 58. That is, the developing-side roller shaft 58 and its associated developing-side roller portion 60 are incapable of rotating independently of each other but rotating together.

The developing-side roller shaft 58 is substantially in the form of a cylinder extending in the left-to-right direction. Both ends of the developing-side roller shaft 58 are rotatably supported by the supports 55 formed on the developing flame 51. The right-side end portion of the developing-side roller shaft 58 projects rightward from the outer surface of the right-side supporting portion 55.

The developing-side roller portion 60 is substantially in the form of a cylinder extending in the left-to-right direction. When the developing-side roller portion 60 is viewed from the right or left side, it protrudes from the outer profile of the front, front lower, and lower portions of the support 55. The inner diameter of the developing-side roller portion 60 is approximately equal to the outer diameter of the developing side roller shaft 58. The left-to-right length of the developing-side roller portion 60 is longer than the widthwise length of the sheet of paper P as can be seen from FIG. 2B.

The developing unit 22 includes a developing-side coupling gear 90 that is substantially in the form of a cylinder extending in the left-to-right direction.

The developing-side coupling gear 90 is coupled to a motor (driving source) 100 to be driven thereby via a housing-side coupling gear (not shown). The motor 100 is disposed in the housing 2. The developing-side coupling gear 90 includes an engagement portion 87 and a gear portion 88. The engagement portion 87 is provided at the left side of the developing-side coupling gear 90. The housing-side coupling gear disposed at the right side of the engagement portion 87 engages the latter so as to be rotated together. That is, the housing-side coupling gear and the engagement portion 87 are incapable of rotating independently of each other. The gear portion 88 is rotatably disposed at the right side of the developing-side coupling gear 90 and is formed with cut teeth on the outer periphery.

The developing roller 23 is made up of a developing roller shaft 91 as a rotation shaft, and a developing roller drive gear 92. The developing roller shaft 91 is substantially in the form of a cylinder extending in the left-to-right direction. The right end portion of the developing roller shaft 91 projects rightward from the developing frame 51. Both ends of the developing roller shaft 91 are rotatably supported on the developing frame 51.

The developing roller drive gear 92 has a diameter smaller than the diameter of the developing roller 23. The developing roller drive gear 92 is rotatably disposed at the right side of the developing frame 51. The developing roller drive gear 92 rotates together with the developing roller shaft 91 and meshingly engages the gear portion 88 of the developing-side coupling gear 90.

The supply roller 24 is made up of a supply roller shaft 93 as a rotation shaft, and a supply roller drive gear 94. The supply roller shaft 93 is substantially in the form of a cylinder extending in the left-to-right direction. The right end portion of the supply roller shaft 93 projects rightward from the developing frame 51. Both ends of the supply roller shaft 93 are rotatably supported on the developing frame 51.

The supply roller drive gear 94 has a diameter approximately equal to the diameter of the supply roller 24. The supply roller drive gear 94 is rotatably disposed at the right side of the developing frame 51. The supply roller drive gear 94 rotates together with the supply roller shaft 93 and meshingly engages the gear portion 88 of the developing-side coupling gear 90.

The agitator 40 is made up of an agitator shaft 95 as a rotational shaft, and an agitator drive gear (first drive gear) 96. The agitator shaft 95 is substantially in the form of a cylinder extending in the left-to-right direction. The right end portion of the agitator shaft 95 projects rightward from the developing frame 51. Both ends of the agitator shaft 95 are rotatably supported on the developing frame 51.

The agitator drive gear 96 has an axial length about a half of the axial length of the supply roller drive gear 94. The agitator drive gear 96 is rotatably disposed at the right side of the developing frame 51. The agitator drive gear 96 rotates together with the developing-side roller shaft 58. That is, the agitator drive gear 96 and the developing-side roller shaft 58 are incapable of rotating independently of each other. The conveying member drive gear 97 meshingly engages the agitator drive gear 96.

In operation, the driving force of the motor 100 is transmitted to the developing-side coupling gear 90 via the housing-side coupling gear. The developing-side coupling gear 90 is rotated clockwise as viewed from right. In the following description, the terms "clockwise" and "counterclockwise" will be used to refer to the rotational directions as viewed from right. Both the developing roller drive gear 92 and the supply roller drive gear 94 are meshingly engaged with the gear portion 88 rotating counterclockwise. Then, the developing roller drive gear 92 imparts driving force to the developing roller 23 via the developing roller shaft 91 to rotate counterclockwise. At the same time, the supply roller drive gear 94 imparts the driving force to the supply roller 24 via the supply roller shaft 93 to rotate counterclockwise. In this way, both the developing roller 23 and the supply roller 24 rotate counterclockwise.

In accordance with the counterclockwise rotations of the supply roller drive gear 94, the agitator drive gear 96 meshingly engaged with the supply roller drive gear 94 rotates clockwise. The agitator drive gear 96 imparts driving force to the agitator 40 via the agitator shaft 95 to rotate clockwise, so that the agitator 40 rotates clockwise. In accordance with the clockwise rotations of the agitator drive gear 96, the feed roller drive gear 97 meshingly engaged with the agitator drive gear 96 is rotated counterclockwise.

Then, the feed roller drive gear 97 imparts driving force to the developing-side feed roller 54 via the developing-side roller shaft 58 to rotate counterclockwise. That is, the developing-side feed roller 54 is rotated to move the sheet of paper P from front to rear at a position below the developing-side roller portion 60. In this manner, the driving force imparted to the developing-side coupling gear 90 is transmitted to both the agitator drive gear 96 and the feed roller drive gear 97 via the supply roller drive gear 94. The developing-side coupling gear 90 and the supply roller drive gear 94 function as a driving force transmitting member.

Next, referring to FIG. 1, sheet conveyance along a second conveying path will be described. A sheet of paper P inserted into the opening 75 functioning as a manual insertion port passes above the upper surface of the grip portion 57 of the sheet tray 8 and is guided to move toward the nip between the developing-side feed roller 54 and the housing-side feed roller 64 positioned nearest to the grip portion 57 by the aid of the front-side guide surface 76 formed in the sheet conveying member 61.

The sheet of paper P is conveyed rearward by the developing-side feed roller 54 and the housing-side feed roller 64 while being guided by the guide portions 56 of the respective developing units 22. Thus, the sheet of paper P passes a space between the lower portion of each developing unit 22 and the upper surface of the sheet conveying member 61. That is, each of the developing-side feed rollers 54 and its associated housing-side feed roller 64 cooperate each other to convey the sheet of paper P. Then, in the rear end of the sheet conveying member 61, the sheet of paper P is guided to move toward the rear end portion of the lift member 9 by the aid of the rear-side guide surface 77.

The sheet of paper P having conveyed through the second conveying path and reached the rear end of the lift member 9 is further conveyed by the rotations of the sheet feed roller 11 and passes through the nip between the sheet feed roller 11 and each of the pinch rollers 13. The sheet of paper P is then conveyed toward the registration rollers 14. The registration rollers 14 supplies the sheet of paper P to the position N between the intermediate image transfer belt 30 and the secondary image transfer roller 27 at a prescribed timing.

Figure 3:
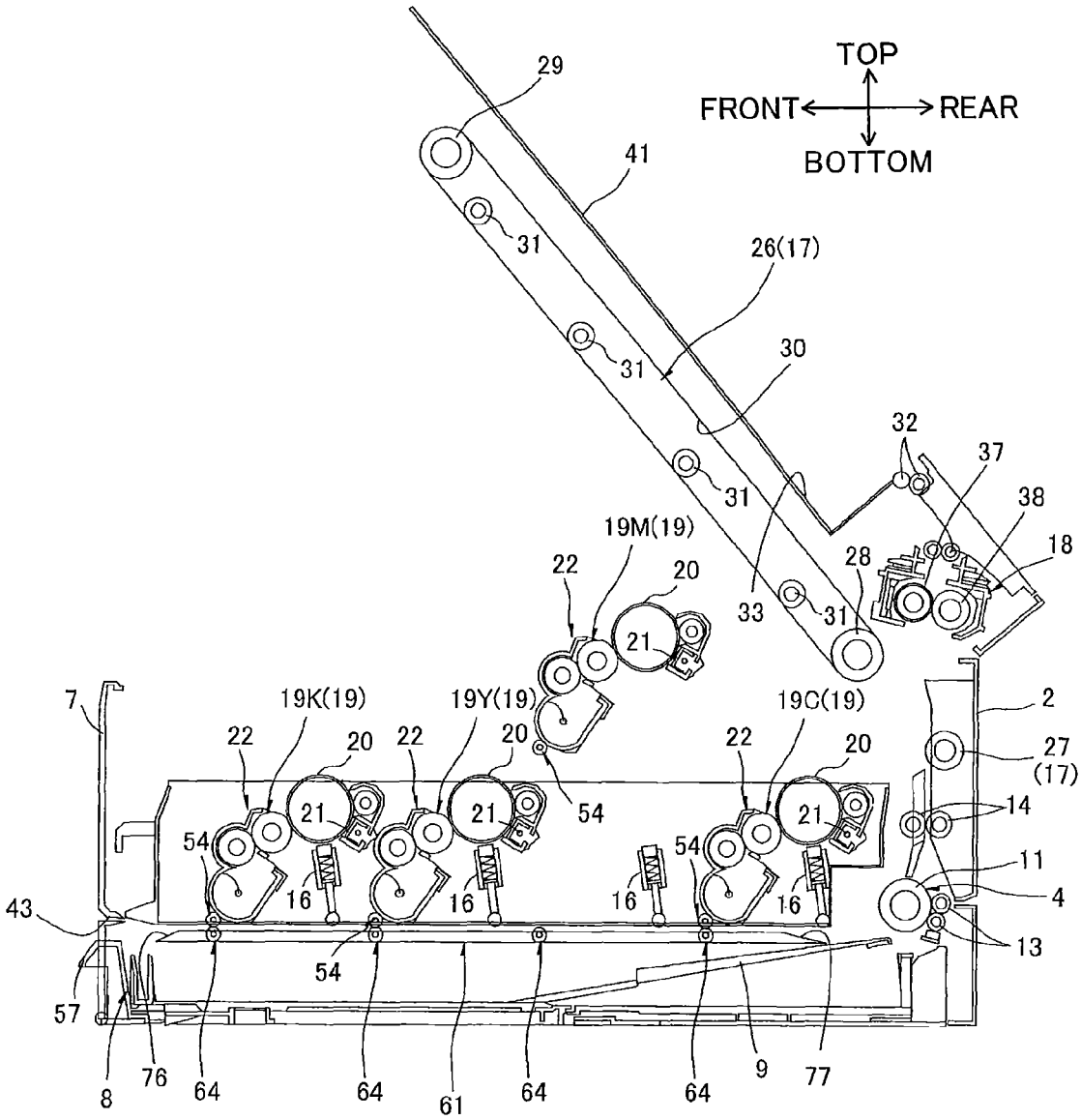
FIG. 3 is a vertical cross-sectional view illustrating how to recover a jam occurred in a second conveyance path.

Paper jam which may occur during conveyance of the sheet of paper P along the second conveying path can be recovered by removing the jammed paper from the upper opening of the housing 2. Removal of the jammed paper can be performed in the following way. First, the top cover 41 is pivotally upwardly moved as shown in FIG. 3 to expose the upper opening of the housing 2. Then, the process cartridges 19 are drawn upward to detach from the housing 2. Since the jammed paper will be exposed on the sheet conveying member 61, all the user has to do is removing the jammed paper in this state.

Figure 4:
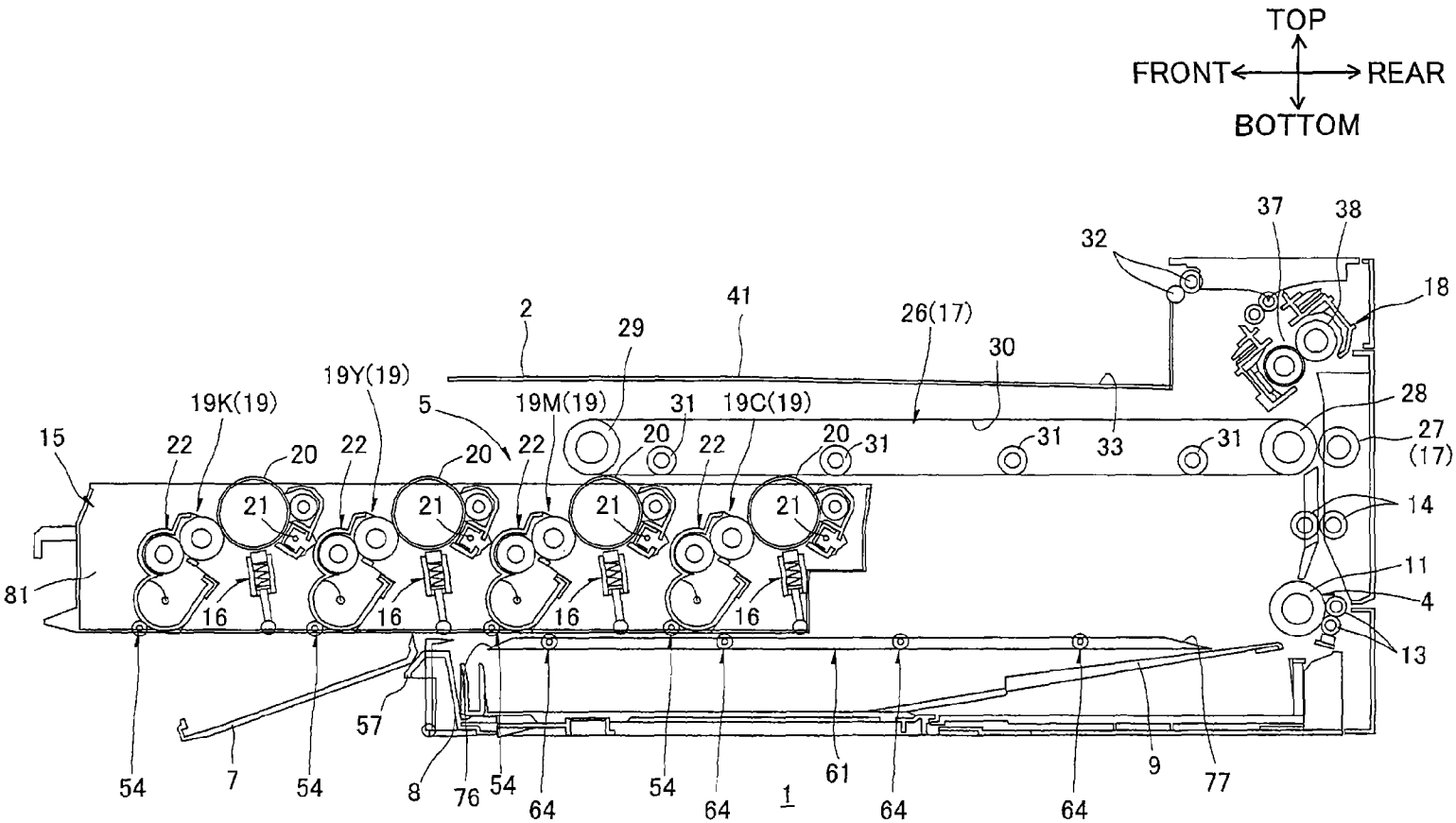
FIG. 4 is a vertical cross-sectional view illustrating how to mount a process cartridge in and remove the process cartridge from the color printer shown in FIG. 1.

In order to mount the process cartridges 19 in and remove the process cartridges 19 from the housing 2, the front cover 7 is firstly moved from the closed position to an open position as shown in FIG. 4. Then, the process unit 15 is drawn frontward to project from the housing 2. One or more of the process cartridges 19 is dismounted from the process unit 15 by drawing it upward and a new process cartridge 19 is mounted in place of the used process cartridge 19. To mound the new process cartridge 19 in the process unit 15, the process cartridge 19 is firstly positioned with respect to a support portion on the process frame 81 (not shown) and then downwardly pushed to be mounted into the process frame 81. Mounting the process unit 15 into the housing 2 can be effected by performing an operation reversal to the process unit dismounting operation.

In accordance with the color printer 1 described above, the developing-side feed roller 54 provided in each detachable process cartridge 19 and the associated housing-side feed roller 64 cooperate each other to convey the sheet of paper P rearward. As such, dismounting the process cartridge 19 from the housing 2 can separate the developing-side feed roller 54 from the housing-side feed roller 64. This configuration facilitates removal of the sheet of paper P jammed between the developing-side feed roller 54 and the housing-side feed roller 64.

The above-described color printer 1 is configured to provide a counterpart feed roller to a detachable process cartridge, so that the color printer 1 so configured can be downsized as compared with a printer in which a pair of feed rollers is provided in the housing 2.

As shown in FIG. 2, the color printer 1 in accordance with the embodiment is configured to include various gears to which driving force generated by the motor 100 is imparted. The gears include agitator drive gear 96 for driving the agitator 40, the developing-side coupling gear 90 for transmitting the driving force to the feed roller drive gear 97 that drives the developing-side feed roller 54, and the supply roller drive gear 94. With such a configuration, the developing-side feed roller 54 can be driven utilizing the driving force for driving the agitator 40.

Further, as shown in FIG. 2, the color printer 1 includes the developer-side feed roller 54 having an axial length greater than the widthwise length of the sheet of paper P, so that a stable conveyance of the sheet of paper P can be achieved. Furthermore, the housing-side feed roller 64 is rotated following the rotations of the developing-side feed roller 54. Thus, there is no need to supply drive force to independently drive the housing-side feed roller 64.

As shown in FIG. 2, the process cartridge 19 used in the color printer 1 is formed at the lower portion with the guide portion 56 for guiding the conveyance of the sheet of paper P. The guide portion 56 promises a stable conveyance of the sheet of paper P.

The process cartridge 19 is provided with the developing-side feed roller 54 having a size to overlap the developing frame 51 if the developing-side feed roller 54 is projected in the front-to-rear direction. With such a configuration, the vertical size of the process cartridge 19 can be suppressed, thereby making it possible to down-size the color printer 1.

As shown in FIG. 1, the color printer 1 includes the sheet tray 8 disposed below the housing-side feed roller 64. This configuration allows the developing-side feed roller 54 and the housing-side feed roller 64 to provide in between the sheet tray 8 and the process unit 15. The second sheet feed path can be formed in this space. The inner space of the housing 2 is effectively utilized in providing a sheet feed path, the color printer 1 can be down-sized.

While the invention has been described in detail with reference to the embodiment thereof, it would be apparent to those skilled in the art that various changes and modifications may be made therein without departing from the spirit of the invention.

What is claimed is:

1. An image forming apparatus comprising:

a housing;

a driving source generating driving force;

an endless belt circularly movably disposed in the housing, the endless belt having a first part moving in a first direction and a second part moving in a second direction opposite the first direction;

a plurality of process cartridges detachably provided in the housing and juxtaposed along the first part of the endless belt, each of the plurality of process cartridges including a photosensitive drum extending in a third direction perpendicular to the first direction and the second direction to confront the first part of the endless belt, a developing agent carrying member disposed in confronting relation with the photosensitive drum for supplying toner to the photosensitive drum;

a first conveying member provided in each of the plurality of process cartridges; and a second conveying member provided in the housing, the first conveying member conveying a recording sheet in the first direction in cooperation with the second conveying member.

2. The image forming apparatus according to claim 1, wherein each of the plurality of process cartridges comprises:

an agitator configured to agitate developing agent;

a first drive gear configured to drive the agitator, the first drive gear and the agitator being incapable of rotating independently of each other but being rotated together;

a second drive gear configured to drive the first conveying member, the second drive gear and the first conveying member being incapable of rotating independently of each other but being rotated together; and a driving force transmitting member configured to transmit the driving force generated by the driving source to both the first drive gear and the second drive gear.

3. The image forming apparatus according to claim 1, wherein the first conveying member has a first length in the third direction, and the recording sheet has a second length in the third direction, the first length being longer than the second length.

4. The image forming apparatus according to claim 1, wherein the first conveying member is operatively coupled to the driving source and driven by the driving force transmitted from the driving source, and the second conveying member is driven following the first conveying member.

5. The image forming apparatus according to claim 1, wherein each of the plurality of process cartridges includes a guide member that is configured to guide conveyance of the recording sheet.

6. The image forming apparatus according to claim 1, wherein each of the plurality of process cartridges includes a cartridge case in which the developing agent carrying member is held and the developing agent is accommodated, and the first conveying member has a size to overlap the cartridge case when the first conveying member and the cartridge case are projected in the first direction.

7. The image forming apparatus according to claim 1, wherein the housing houses a tray on which a plurality of recording media is stacked, the tray being disposed outside the first part of the endless belt where the plurality of process cartridges is provided.

8. The image forming apparatus according to claim 1, wherein the first part of the endless belt is lower in vertical position than the second part of the endless belt.

* * * * *